US005577450A

United States Patent [19]

Huang

[11] Patent Number: 5,577,450

[45] Date of Patent: Nov. 26, 1996

[54] VARIABLE-LENGTH TABLE

[76] Inventor: Chien-Hsiung Huang, No. 25, Lane 141, Chung-Yang St., Ping-Tung City, Taiwan

[21] Appl. No.: 430,325

[22] Filed: Apr. 26, 1995

[51] Int. Cl.[6] ..... A47B 1/00

[52] U.S. Cl. ..... 108/86; 108/87

[58] Field of Search ..... 108/83, 86, 87

[56] References Cited

U.S. PATENT DOCUMENTS

| | | | |
|---|---|---|---|
| 2,092,280 | 9/1937 | Knechtel | 108/87 |
| 4,553,485 | 11/1985 | Lee | 108/87 |
| 4,794,869 | 1/1989 | Chiu | 108/87 |

*Primary Examiner*—Peter M. Cuomo
*Assistant Examiner*—Gerald A. Anderson
*Attorney, Agent, or Firm*—Darby & Darby, P.C.

[57] ABSTRACT

A variable-length table has a tabletop assembly which includes two leg mounting boards, two guide beams that interconnect the leg mounting boards, two connecting beam sets, two fixed tabletop units and a removable tabletop unit. Each connecting beam set includes two connecting beams disposed respectively on two sides of a corresponding one of the guide beams and mounted slidably thereto. Each fixed tabletop unit is mounted on a respective one of the connecting beams of each of the connecting beam sets. The removable tabletop unit includes a board member that is to be disposed removably between the fixed tabletop units when the fixed tabletop units are pulled apart so as to obtain a longer table length, and an opposite pair of flanges that are mounted foldably on the board member thereof and that cooperate with flanges of the fixed tabletop units so as to conceal the guide beams and the connecting beam sets when the longer table length is obtained. The removable tabletop unit can be concealed fully within a space formed between the leg mounting boards and the board member of the fixed tabletop units when the fixed tabletop units are pushed toward each other to obtain a shorter table length.

5 Claims, 6 Drawing Sheets

VARIABLE-LENGTH TABLE

BACKGROUND OF THE INVENTION

1. Field of the Invention

The invention relates to a table, more particularly to a variable-length table which requires a minimum packaging volume to minimize transport costs.

2. Description of the Related Art

Referring to FIGS. 1 and 2, a conventional variable-length table is shown to comprise a leg assembly 1 and a tabletop assembly 2. The leg assembly 1 includes two upright leg units 11. Each leg unit 11 includes two leg posts 110. The tabletop assembly 2 includes two leg mounting boards 20, two guide beams 21, two connecting beam sets, two fixed tabletop units 23 and a removable tabletop unit 24.

Each leg mounting board 20 is mounted on one of the leg units 11 such that the leg posts 110 of the corresponding leg unit 11 are connected to a bottom surface of two end portions of the leg mounting board 20. Each guide beam 21 is mounted to a top surface of one of the end portions of each of the leg mounting boards 20. The guide beams 21 are transverse to the leg mounting boards 20 and are parallel to each other. A pinion 210 is mounted on a top surface of an intermediate portion of each guide beam 21. The connecting beams 22 of each connecting beam set are disposed respectively on two sides of a corresponding one of the guide beams 21 and are mounted slidably thereto. The connecting beams 22 in each of the connecting beam sets are provided with a respective rack 220 that meshes with the pinion 210 on the corresponding one of the guide beams 21. Each of the fixed tabletop units 23 includes a semi-circular board member 231 with a bottom surface mounted on a respective one of the connecting beams 22 of each of the connecting beam sets. The racks 220 on the connecting beams 22 and the pinions 210 on the guide beams 21 ensure simultaneous lateral movement of the connecting beams 22 of the connecting beam sets when the fixed tabletop units 23 are pushed toward each other to obtain a shorter table length or are pulled apart to obtain a longer table length. The removable tabletop unit 24 includes a rectangular board member 241 that is to be disposed removably between the fixed tabletop units 23 when the fixed tabletop units 23 are pulled apart so as to obtain the longer table length. A locking unit 25 is provided on the bottom surfaces of the fixed and removable tabletop units 23, 24 to secure the removable tabletop unit 24 to the fixed tabletop units 23 when the longer table length is obtained (see FIG. 2).

Referring to FIGS. 1 and 2, each of the fixed tabletop units 23 further has a curved flange 230 that extends downwardly from the board member 231 for concealing the guide beams 21 and the connecting beams 22 of the connecting beam sets so as to enhance appearance of the table when the shorter table length is obtained. The removable tabletop unit 24 further has an opposite pair of flanges 240 that are mounted fixedly on and that extend downwardly from the board member 241. The flanges 240 cooperate with the flanges 230 of the fixed tabletop units 23 so as to conceal the guide beams 21 and the connecting beams 22 of the connecting beam sets when the longer table length is obtained.

As mentioned beforehand, the removable tabletop unit 24 is removed, and the fixed tabletop units 23 are pushed toward each other to obtain the shorter table length. Albeit a space (T) is formed between the top surface of the leg mounting boards 20 and the bottom surface of the board members 231 of the fixed tabletop units 23, the removable tabletop unit 24 cannot be concealed in the space (T) because the sum of the height of the flanges 240 and the thickness of the board member 241 is greater than the depth (t) of the space (T), thereby arising in a storage problem for the removable tabletop unit 24 when the shorter table length is in use.

As shown in FIG. 3, the conventional variable-length table is usually dismantled during transport to reduce the space occupied thereby. The fixed tabletop units 23 are pushed toward one another to obtain the shorter table length, the removable tabletop unit 24 is disposed on top of the fixed tabletop units 23, and the leg posts 110 are detached from the tabletop assembly 2 and are disposed in a U-shaped space that is confined by the removable tabletop unit 24. If the removable tabletop unit 24 can be concealed within the space (T), the packaging volume of the conventional variable-length table will be further reduced to result in lower transport costs.

It is noted that the height of the flanges 230, 240 may be reduced so that the sum of the height of the flanges 240 and the thickness of the board member 24 is less than or equal to the depth (t) of the space (T) in order to permit concealing of the removable tabletop unit 24 in the space (T). However, doing so would adversely affect the appearance of the table since the flanges 230, 240 will be incapable of concealing fully the guide beams 21 and the connecting beams 22 of the connecting beam sets. Alternatively, the depth (t) of the space (T) may be increased so that the removable tabletop unit 24 can be concealed in the latter. The appearance of the table is not adversely affected since the flanges 230, 240 still conceal fully the guide beams 21 and the connecting beams 22.

SUMMARY OF THE INVENTION

The object of the present invention is to provide a variable-length table which includes a removable tabletop unit that can be concealed therein when the latter is not in use and which requires a minimum packaging volume to minimize the transport costs incurred.

Accordingly, a variable-length table of the present invention comprises a leg assembly which includes two upright leg units, and a tabletop assembly. The tabletop assembly includes: two leg mounting boards mounted respectively on the leg units; two guide beams which interconnect the leg mounting boards, the guide beams being transverse to the leg mounting boards and being parallel to each other; two connecting beam sets, each including two connecting beams disposed respectively on two sides of a corresponding one of the guide beams and mounted slidably thereto; two fixed tabletop units, each including a board member mounted on a respective one of the connecting beams of each of the connecting beam sets, and a flange that extends downwardly from the board member for concealing the guide beams and the connecting beam sets when the fixed tabletop units are pushed toward each other to obtain a shorter table length; and a removable tabletop unit including a board member that is to be disposed removably between the fixed tabletop units when the fixed tabletop units are pulled apart so as to obtain a longer table length, and an opposite pair of flanges that are mounted on the board member thereof and that cooperate with the flanges of the fixed tabletop units so as to conceal the guide beams and the connecting beam sets when the longer table length is obtained. A space is formed between the leg mounting boards and the board member of the fixed tabletop units. The sum of the height of the flanges of the removable tabletop unit and the thickness of the board member of the removable tabletop unit is greater than the depth of the space.

In the variable-length table of this invention, the combined thickness of any one of the flanges of the removable tabletop unit and the board member of the removable tabletop unit is less than the depth of the space. The removable tabletop unit further includes at least two hinge units, each having pivotally connected first and second hinge leaves that are mounted respectively to one of the flanges of the removable tabletop unit and the board member of the removable tabletop unit. The hinge units mount foldably the flanges of the removable tabletop unit to the board member of the removable tabletop unit. Thus, the removable tabletop unit can be concealed fully within the space when the shorter table length is obtained.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 4:
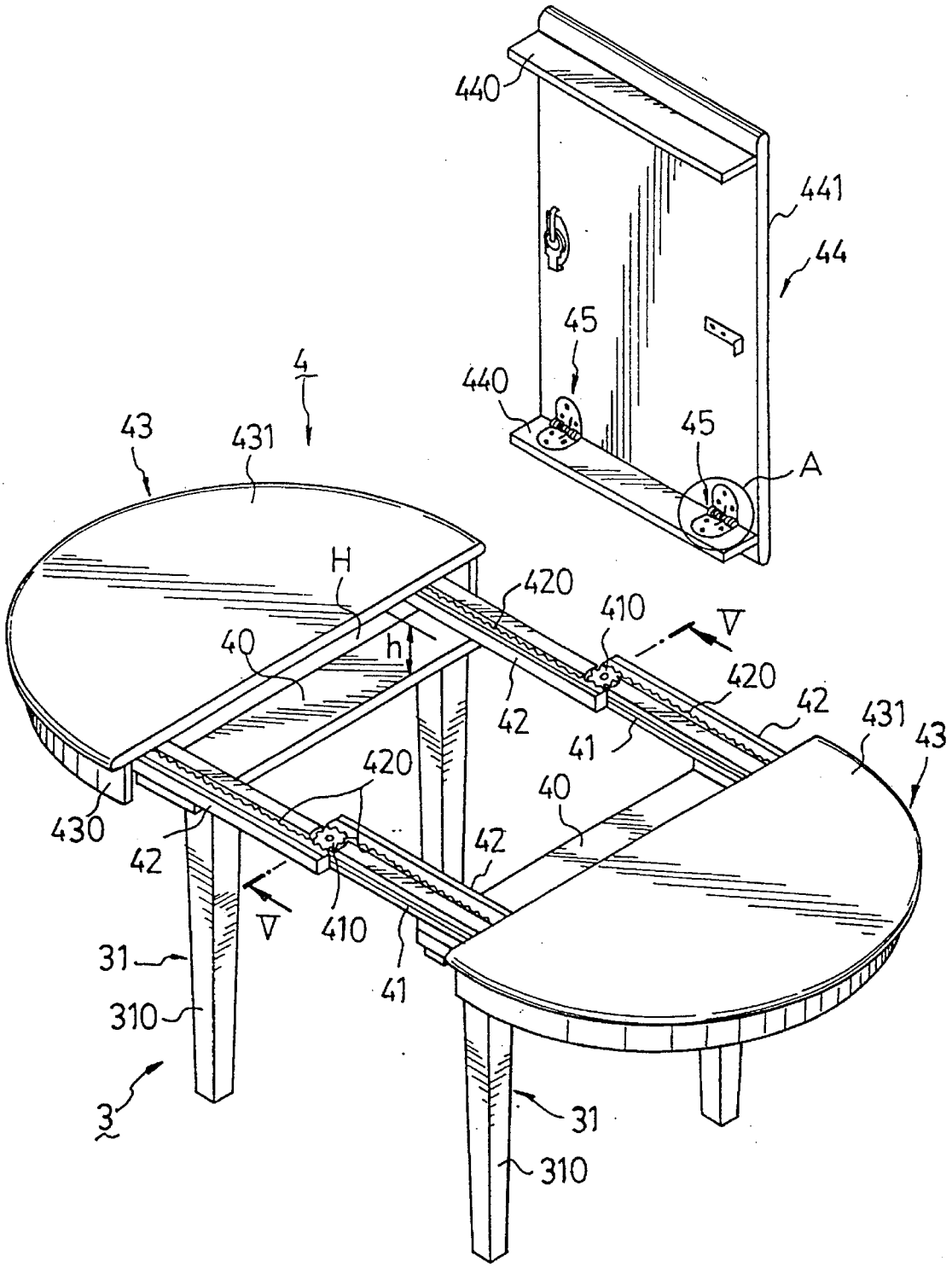
FIG. 4 is a perspective view of the first preferred embodiment of a variable-length table according to the present invention.
Figure 5:
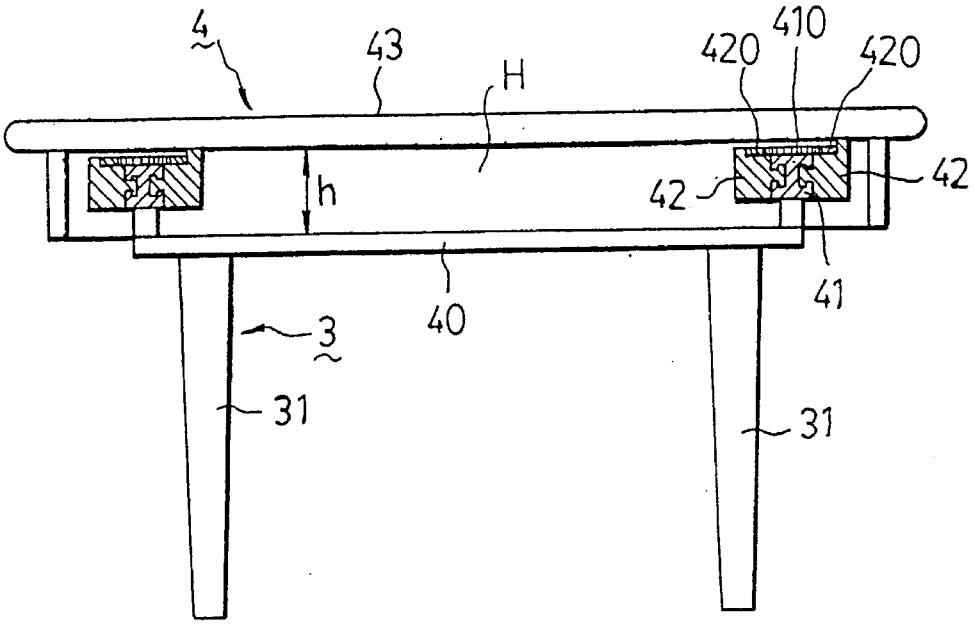
FIG. 5 is a sectional view of the first preferred embodiment taken along line V—V in FIG. 4.

Referring to FIGS. 4 and 5, the first preferred embodiment of a variable-length table according to the present invention is shown to comprise a leg assembly 3 and a tabletop assembly 4. The leg assembly 3 includes two upright leg units 31. Each leg unit 31 includes two leg posts 310. The tabletop assembly 4 includes two leg mounting boards 40, two guide beams 41, two connecting beam sets, two fixed tabletop units 43 and a removable tabletop unit 44.

Each leg mounting board 40 is mounted on one of the leg units 31 such that the leg posts 310 of the corresponding leg unit 31 are connected to a bottom surface of two end portions of the leg mounting board 40. Each guide beam 41 is mounted on a top surface of one of the end portions of each of the leg mounting boards 40. The guide beams 41 are transverse to the leg mounting boards 40 and are parallel to each other. A pinion 410 is mounted on a top surface of an intermediate portion of each guide beam 41. The connecting beams 42 of each connecting beam set are disposed respectively on two sides of a corresponding one of the guide beams 41 and are mounted slidably thereto. The connecting beams 42 of each connecting beam set are provided with a respective rack 420 that meshes with the pinion 410 on the corresponding one of the guide beams 41. Each of the fixed tabletop units 43 includes a semi-circular board member 431 with a bottom surface connected to a respective one of the connecting beams 42 of each of the connecting beam sets. The racks 420 on the connecting beams 42 and the pinions 410 on the guide beams 41 ensure simultaneous lateral movement of the connecting beams 42 when the fixed tabletop units 43 are pushed toward each other to obtain a shorter table length or are pulled apart to obtain a longer table length. The removable tabletop unit 44 includes a rectangular board member 441 that is to be disposed removably between the fixed tabletop units 43 when the fixed tabletop units 43 are pulled apart so as to obtain the longer table length. Each of the fixed tabletop units 43 further has a curved flange 430 that extends downwardly from the board member 431 for concealing the guide beams 41 and the connecting beams 42 of the connecting beam sets so as to enhance appearance of the table when the shorter table length is obtained. The removable tabletop unit 44 further has an opposite pair of flanges 440 that are mounted on the board member 441 and that cooperate with the flanges 430 of the fixed tabletop units 43 so as to conceal the guide beams 41 and the connecting beams 42 of the connecting beam sets when the longer table length is obtained. As shown in FIG. 5, a space (H) is formed between the top surface of the leg mounting boards 40 and the bottom surface of the board members 431 of the fixed tabletop units 43.

Figure 6:
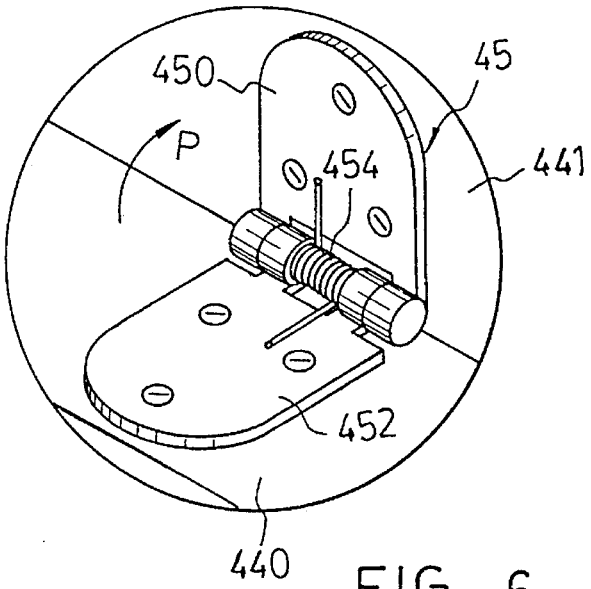
FIG. 6 is an enlarged perspective view of an encircled portion (A) found in FIG. 4.

The main difference between the variable-length table of this embodiment and that of the conventional variable-length table described beforehand resides in the construction of the removable tabletop unit 44. As shown in FIG. 4, the removable tabletop unit 44 further includes two pairs of hinge units 45 (only one pair is shown) for mounting foldably the flanges 440 to the board member 441. Referring to FIG. 6, each hinge unit 45 includes pivotally connected first and second hinge leaves 450, 452 that are mounted respectively to a corresponding one of the flanges 440 and the board member 441. Each hinge unit 45 further includes a spring member 454, such as a torsion spring, for biasing the corresponding one of the flanges 440 in the direction which is indicated by the arrow (P) such that the corresponding one of the flanges 440 is normally perpendicular to the board member 441.

Figure 7:
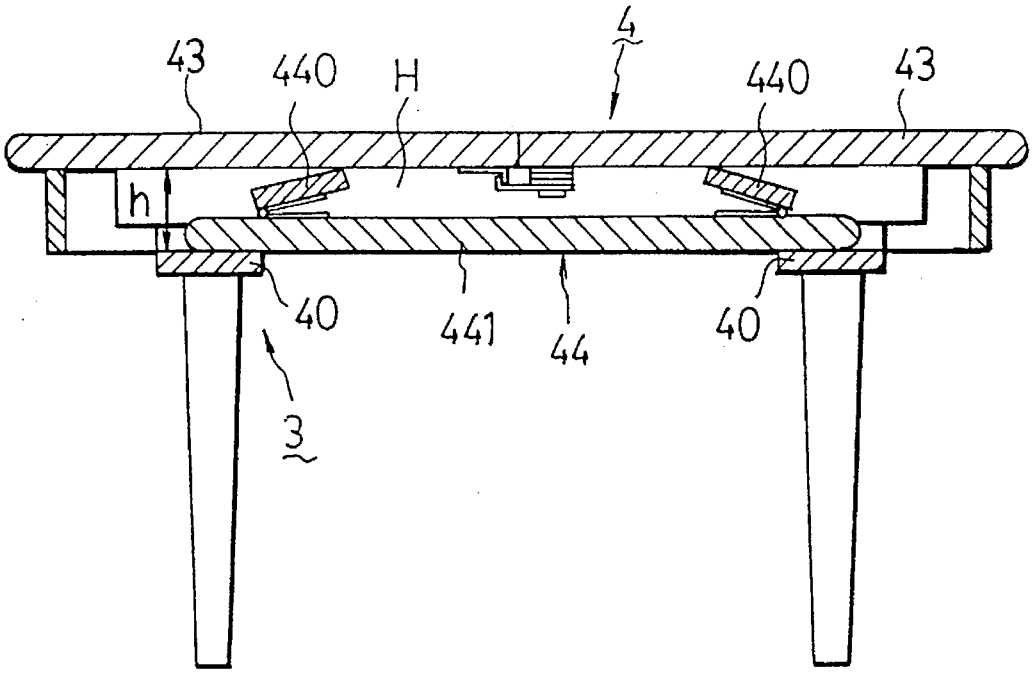
FIG. 7 is a sectional view showing the first preferred embodiment when a shorter table length is obtained.

FIG. 7 shows the first preferred embodiment when a shorter table length is obtained. As illustrated, the removable tabletop unit 44 is disposed in the space (H) such that the board member 441 is supported on the leg mounting boards 40 and the flanges 440 extend upwardly. When the fixed tabletop units 43 are pushed toward each other to obtain the shorter table length, the fixed tabletop units 43 push the flanges 440 to pivot toward the board member 441 against biasing action of the spring members 454 of the hinge units 45. Note that the combined thickness of any one of the flanges 440 and the board member 441 must be less than the depth (h) of the space (H). Thus, when the shorter table length is obtained, the removable tabletop unit 44 can be concealed fully within the space (H) even though the sum of the height of the flanges 440 and the thickness of the board member 441 is greater than the depth (h) of the space (H).

Figure 1:
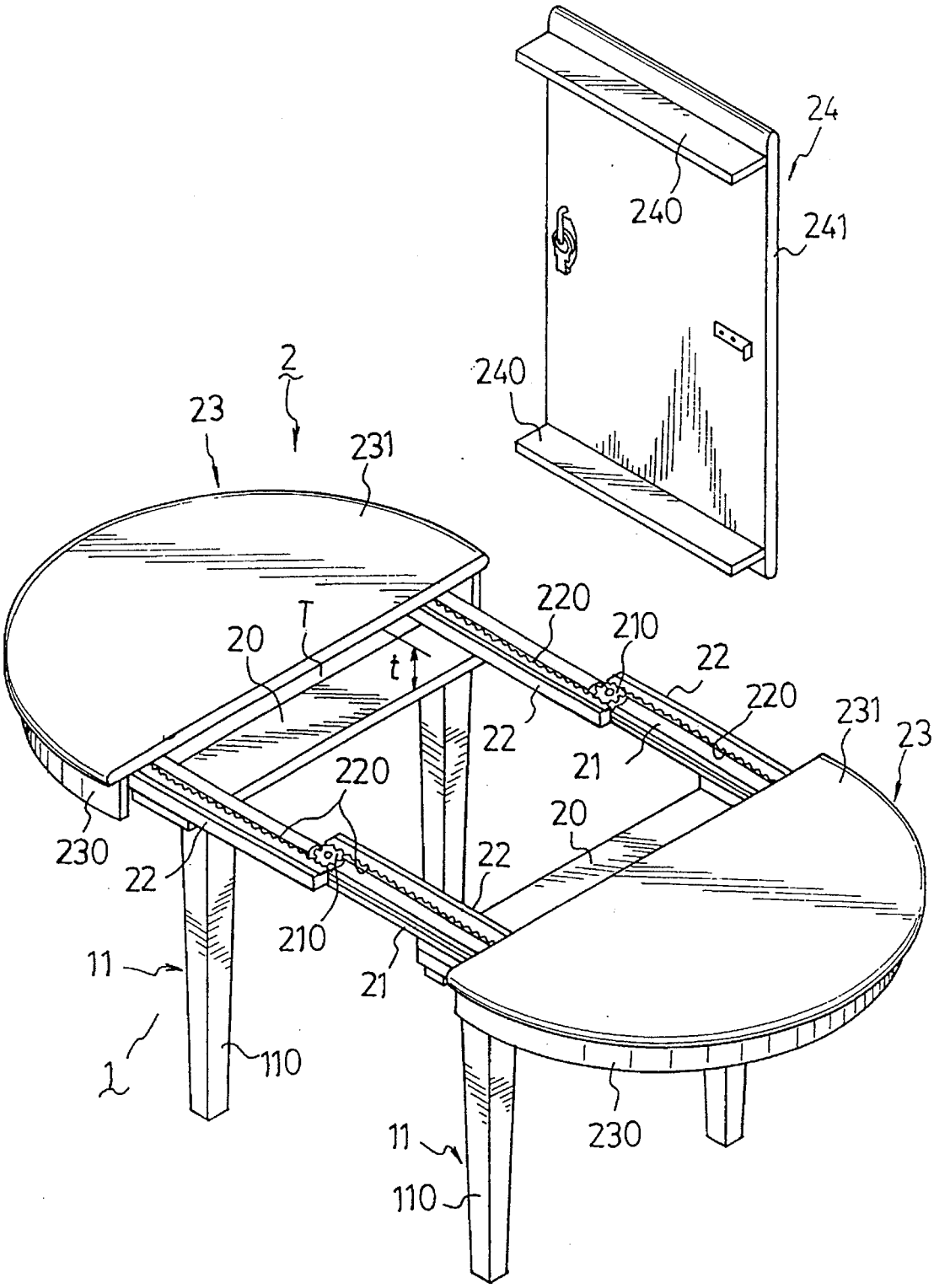
FIG. 1 PRIOR ART
FIG. 1 is a perspective view of a conventional variable-length table.
Figure 2:
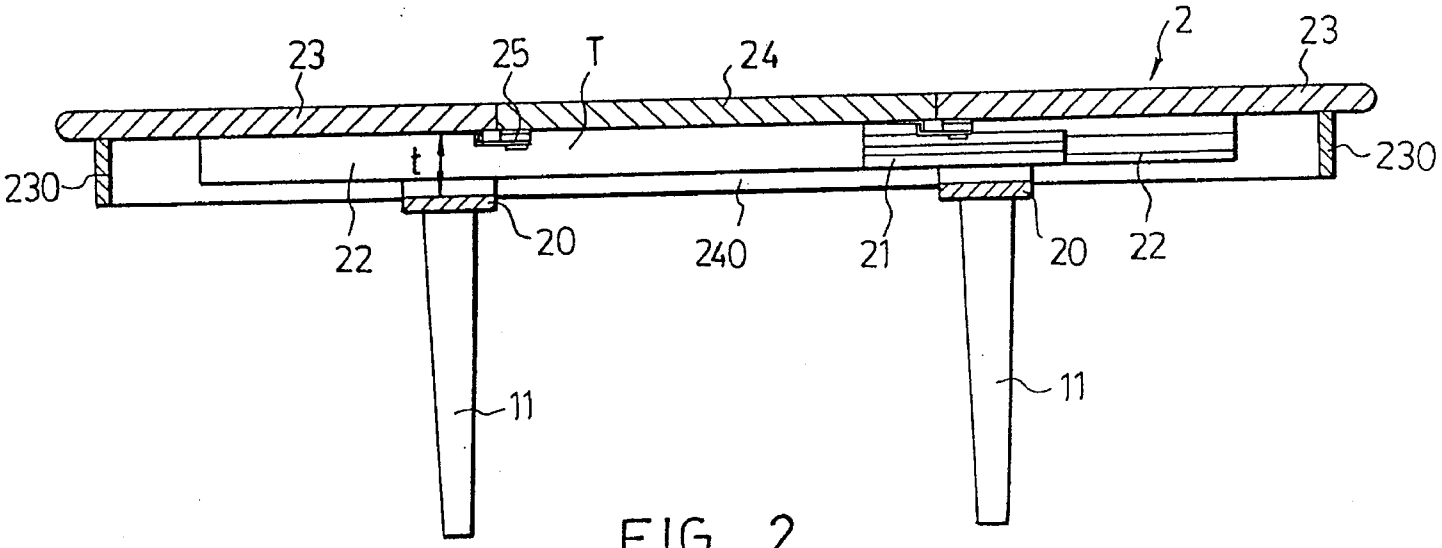
FIG. 2 PRIOR ART
FIG. 2 is a sectional view showing the conventional variable-length table when a longer table length is obtained.
Figure 3:
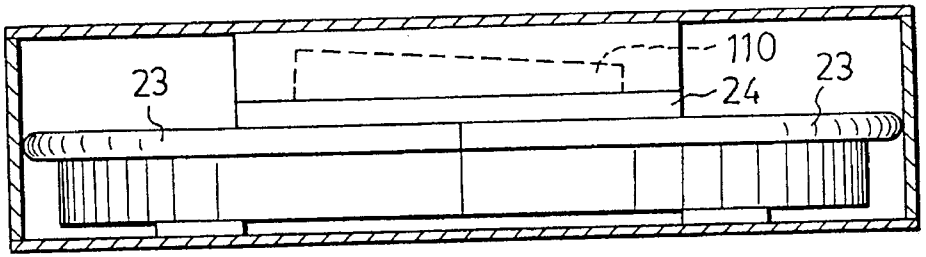
FIG. 3 PRIOR ART
FIG. 3 illustrates how the conventional variable-length table is packed for transport purposes.
Figure 8:
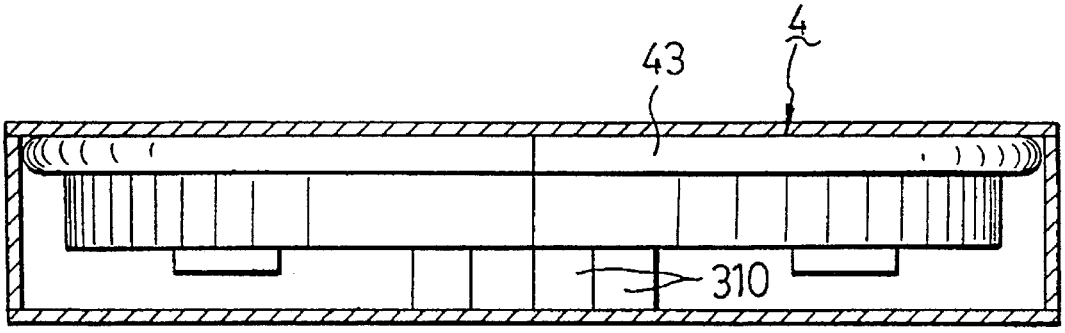
FIG. 8 illustrates how the first preferred embodiment is packed for transport purposes.

FIG. 8 illustrates how the variable-length table of the first preferred embodiment is packed for transport purposes. As shown, the removable tabletop unit 44 is concealed within the space (H), and the fixed tabletop units 43 are pushed toward one another to obtain the shorter table length. The leg posts 310 are detached from the tabletop assembly 4 and are arranged below the latter. Since the removable tabletop unit 44 can be concealed within the space (T), the packaging volume of the variable-length table of this invention is much less than that of the conventional variable-length table shown in FIG. 3, thereby resulting in lower transport costs.

In the present invention, the removable tabletop unit 44 can be disposed in the space (H) without reducing the height of the flanges 430, 440. Thus, the appearance of the table is not adversely affected since the flanges 430, 440 are capable of concealing fully the guide beams 41 and the connecting beams 42 of the connecting beam sets. In addition, since there is no need to increase the depth (h) of the space (H) so that the removable tabletop unit 44 can be concealed in the latter, the packaging volume required by the variable-length table of this invention is kept at a minimum to minimize the transport costs.

Figure 9:
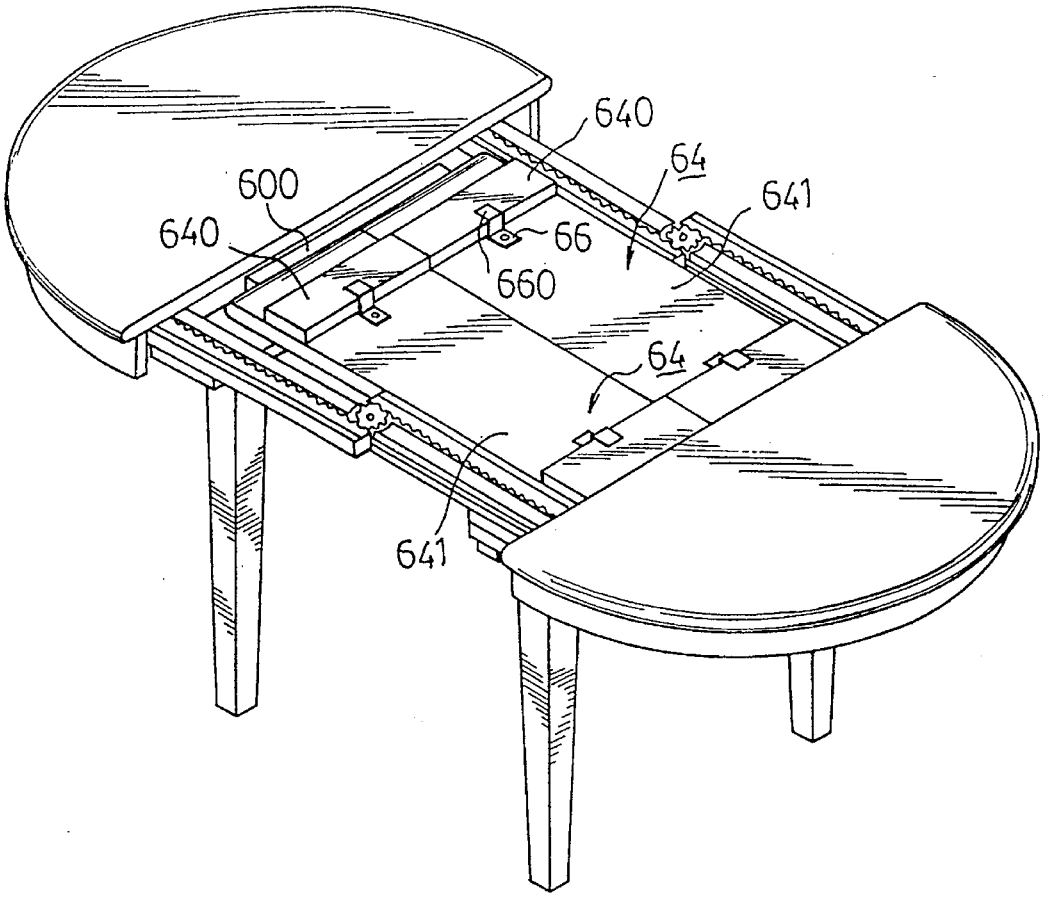
FIG. 9 is a perspective view of the second preferred embodiment of a variable-length table according to the present invention.
Figure 10:
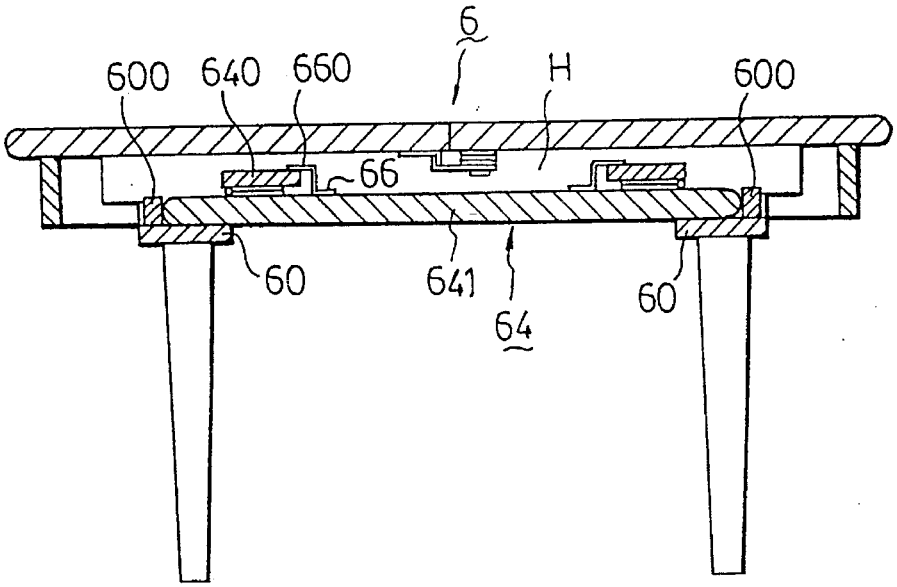
FIG. 10 is a sectional view showing the second preferred embodiment when a shorter table length is obtained.

FIGS. 9 and 10 illustrate the second preferred embodiment of a variable-length table according to the present invention. The second preferred embodiment is generally similar to the previous embodiment, the main difference residing in the configuration of the tabletop assembly 6. In this embodiment, the tabletop assembly 6 includes two removable tabletop units 64 to obtain three different table lengths. Each of the leg mounting boards 60 is formed with an upward guard projection 600 adjacent to a distal longitudinal edge thereof. The guard projections 600 confine the removable tabletop units 64 therebetween when the latter are received in the space (H) to prevent untimely removal of the tabletop units 64 from the space (H). In addition, each of the removable tabletop units 64 is provided with two retaining units 66, each having a press portion 660 and being mounted rotatably on the bottom surface of the board member 641 adjacent to a respective one of the flanges 640. When the retaining units 66 are rotated such that the press portions 660 extend over the respective one of the flanges 640, the flanges 640 are retained in a folded position adjacent to the board member 641 against biasing action of the spring members of the hinge units (not shown).

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A variable-length table comprising:

a leg assembly which includes two upright leg units; and a tabletop assembly which includes:

two leg mounting boards mounted respectively on said leg units;

two guide beams interconnecting said leg mounting boards, said guide beams being transverse to said leg mounting boards and being parallel to each other;

two connecting beam sets, each including two connecting beams disposed respectively on two sides of a corresponding one of said guide beams and mounted slidably thereto;

two fixed tabletop units, each including an end board member mounted on a respective one of said connecting beams of each of said connecting beam sets, and an end flange that extends downwardly from said end board member for concealing said guide beams and said connecting beam sets when said fixed tabletop units are pushed toward each other to obtain a shorter table length; and a removable tabletop unit including a central board member that is to be disposed removably between said fixed tabletop units when said fixed tabletop units are pulled apart so as to obtain a longer table length, and an opposite pair of central flanges that are mounted on said central board member and that cooperate with said end flanges of said fixed tabletop units so as to conceal said guide beams and said connecting beam sets when the longer table length is obtained;

a space being formed between said leg mounting boards and said end board member of said fixed tabletop units, said central flanges of said removable tabletop unit having a height, said central board member having a thickness, said space having a depth which is less than a sum of the height of said central flanges of said removable tabletop unit and the thickness of said central board member of said removable tabletop unit;

wherein each of said central flanges of said removable tabletop unit has a thickness, a sum of the thickness of said central flanges of said removable tabletop unit and the thickness of said central board member of said removable tabletop unit being less than the depth of said space; and wherein said removable tabletop unit further includes at least two hinge units, each having pivotally connected first and second hinge leaves that are mounted respectively to one of said central flanges of said removable tabletop unit and said central board member of said removable tabletop unit, said hinge units mounting foldably said central flanges of said removable tabletop unit to said central board member of said removable tabletop unit such that said central flanges extend downwardly from said central board member when the longer table length is obtained;

whereby, said removable tabletop unit can be concealed fully within said space when the shorter table length is obtained, wherein each of said hinge units has a spring member for biasing a corresponding one of said central flanges of said removable tabletop unit to a normally perpendicular position relative to said central board member of said removable tabletop unit.

2. The variable-length table as claimed in claim 1, wherein each of said guide beams has an intermediate portion with a top surface that has a pinion mounted thereon, and said connecting beams in each of said connecting beam sets are provided with a respective rack that meshes with said pinion on the corresponding one of said guide beams.

3. The variable-length table as claimed in claim 1, wherein said spring member is a torsion spring.

4. A variable-length table comprising:

a leg assembly which includes two upright leg units; and a tabletop assembly which includes:

two leg mounting boards mounted respectively on said leg units;

two guide beams interconnecting said leg mounting boards, said guide beams being transverse to said leg mounting boards and being parallel to each other;

two connecting beam sets, each including two connecting beams disposed respectively on two sides of a corresponding one of said guide beams and mounted slidably thereto;

two fixed tabletop units, each including an end board member mounted on a respective one of said connecting beams of each of said connecting beam sets, and an end flange that extends downwardly from said end board member for concealing said guide beams and said connecting beam sets when said fixed tabletop units are pushed toward each other to obtain a shorter table length; and a removable tabletop unit including a central board member that is to be disposed removably between said fixed tabletop units when said fixed tabletop units are pulled apart so as to obtain a longer table length, and an opposite pair of central flanges that are mounted on said central board member and that cooperate with said end flanges of said fixed tabletop units so as to conceal said guide beams and said connecting beam sets when the longer table length is obtained;

a space being formed between said leg mounting boards and said end board member of said fixed tabletop units, said central flanges of said removable tabletop unit having a height, said central board member having a thickness, said space having a depth which is less than a sum of the height of said central flanges of said removable tabletop unit and the thickness of said central board member of said removable tabletop unit;

wherein each of said central flanges of said removable tabletop unit has a thickness, a sum of the thickness of said central flanges of said removable tabletop unit and the thickness of said central board member of said removable tabletop unit being less than the depth of said space; and wherein said removable tabletop unit further includes at least two hinge units, each having pivotally connected first and second hinge leaves that are mounted respectively to one of said central flanges of said removable tabletop unit and said central board member of said removable tabletop unit, said hinge units mounting foldably said central flanges of said removable tabletop unit to said central board member of said removable tabletop unit such that said central flanges extend downwardly from said central board member when the longer table length is obtained;

whereby, said removable tabletop unit can be concealed fully within said space when the shorter table length is obtained, wherein said removable tabletop unit further includes two retaining units, each having a press portion and being mounted rotatably on said central board member of said removable tabletop unit adjacent to a respective one of said central flanges of said removable tabletop unit, said retaining units being rotatable such that the press portions extend over said central flanges of said removable tabletop unit to retain said central flanges of said removable tabletop unit in a folded position adjacent to said central board member of said removable tabletop unit.

5. A variable-length table comprising:

a leg assembly which includes two upright leg units; and a tabletop assembly which includes:

two leg mounting boards mounted respectively on said leg units;

two guide beams interconnecting said leg mounting boards, said guide beams being transverse to said leg mounting boards and being parallel to each other;

two connecting beam sets, each including two connecting beams disposed respectively on two sides of a corresponding one of said guide beams and mounted slidably thereto;

two fixed tabletop units, each including an end board member mounted on a respective one of said connecting beams of each of said connecting beam sets, and an end flange that extends downwardly from said end board member for concealing said guide beams and said connecting beam sets when said fixed tabletop units are pushed toward each other to obtain a shorter table length; and a removable tapletop unit including a central board member that is to be disposed removably between said fixed tabletop units when said fixed tabletop units are pulled apart so as to obtain a longer table length, and an opposite pair of central flanges that are mounted on said central board member and that cooperate with said end flanges of said fixed tabletop units so as to conceal said guide beams and said connecting beam sets when the longer table length is obtained;

a space being formed between said leg mounting boards and said end board member of said fixed tabletop units, said central flanges of said removable tabletop unit having a height, said central board member having a thickness, said space having a depth which is less than a sum of the height of said central flanges of said removable tabletop unit and the thickness of said central board member of said removable tapletop unit;

wherein each of said central flanges of said removable tabletop unit has a thickness, a sum of the thickness of said central flanges of said removable tapletop unit and the thickness of said central board member of said removable tapletop unit being less than the depth of said space; and wherein said removable tabletop unit further includes at least two hinge units, each having pivotally connected first and second hinge leaves that are mounted respectively to one of said central flanges of said removable tabletop unit and said central board member of said removable tabletop unit, said hinge units mounting foldably said central flanges of said removable tabletop unit to said central board member of said removable tabletop unit such that said central flanges extend downwardly from said central board member when the longer table length is obtained;

whereby, said removable tabletop unit can be concealed fully within said space when the shorter table length is obtained, wherein each of said leg mounting boards has a distal longitudinal edge and is formed with an upward guard projection adjacent to the distal longitudinal edge, said guard projections of said leg mounting boards confining said removable tabletop unit therebetween when said removable tabletop unit is concealed in said space.

* * * * *